United States Patent [19]

Maringer

[11] 4,049,042

[45] Sept. 20, 1977

[54] APPARATUS FOR CONTINUOUS CASTING

[75] Inventor: Robert E. Maringer, Worthington, Ohio

[73] Assignee: GTE Laboratories Incorporated, Waltham, Mass.

[21] Appl. No.: 672,569

[22] Filed: Mar. 31, 1976

[51] Int. Cl.[2] ..... B22C 11/06

[52] U.S. Cl. ..... 164/278; 164/87; 164/279; 164/85

[58] Field of Search ..... 164/85, 87, 278, 279

[56] References Cited

U.S. PATENT DOCUMENTS

| | | | |
|---|---|---|---|
| 594,583 | 11/1897 | Wood | 164/278 |
| 3,452,809 | 7/1969 | Dumont-Fillon | 164/278 |
| 3,482,620 | 12/1969 | Dumont-Fillon | 164/278 |
| 3,799,239 | 3/1974 | Dumont-Fillon et al. | 164/278 X |
| 3,941,182 | 3/1976 | Bjorksten et al. | 164/278 X |
| 3,965,965 | 6/1976 | Watts | 164/85 X |

FOREIGN PATENT DOCUMENTS

| | | | |
|---|---|---|---|
| 1,498,360 | 10/1967 | France | 164/278 |
| 512,953 | 9/1939 | United Kingdom | 164/278 |

*Primary Examiner*—Ronald J. Shore

*Attorney, Agent, or Firm*—Irving M. Kriegsman; Robert A. Seldon

[57] ABSTRACT

A continuous casting process is disclosed wherein a plurality of endless flexible belts converge and travel proximate to each other in a common vertical direction to define a travelling mold cavity between the belt faces. Bar shaped products are cast if molten material is poured into the top of a downward moving cavity. Tube shaped products are cast by injection of molten material into the bottom of an upwardly moving cavity.

12 Claims, 5 Drawing Figures

APPARATUS FOR CONTINUOUS CASTING

FIELD OF THE INVENTION

This invention relates to apparatus for the continuous casting of metals. In the continuous casting process, molten metal is continuously cast and fed out in the form of a continuous bar.

DESCRIPTION OF THE PRIOR ART

In one known continuous casting process, molten material is poured downward through a stationary water-jacketed graphite dye. A roller draws the metal from the lower portion of the dye at a rate which is adjustable in accordance with the mass and cooling rate of the cast material. Components thus cast are generally limited to inside diameters greater than seven-sixteenths of an inch for round shapes and one inch for others.

Continuous casting machines are also known, which have a rotatable casting wheel with a circumferential edge face providing a circumferential casting groove. An endless travelling belt is looped about the wheel and has an inner face engaging the edge face over a portion of arc to define, in the region of engagement, a travelling mold cavity. Supply means for supplying the molten metal is arranged adjacent to the wheel, and includes a nozzle member communicating with the mold cavity. The concept and refinements thereof are widely shown in the art and may be found, for example, in U.S. Pat. No. 3,422,881 (Properzi). One detrimental characteristic of these prior art casting machines, is the casting wheel. The size and required balancing of the wheel contribute significantly to the cost of the casting machines. Additionally, there exists a practical limitation on the diameter of the casting wheel, even though it is known that a large diameter lessens the amount of straightening to which a cast bar is subjected as it leaves the wheel. Additionally, the casting of high temperature metals causes thermally induced compressional stress along the rigid wheel structure which may be greater than the yield point of the wheel material. As a result, the peripheral groove may crack or otherwise deteriorate quite rapidly, necessitating replacement of the wheel.

A third continuous casting process provides an endless chain of metal blocks which travel at a shallow downward angle. Upwardly-facing block cavities are filled with molten material at the higher end of travel, and are subsequently sealed by the lower face of an endless belt travelling in a parallel path above the blocks.

SUMMARY OF THE INVENTION

It is, therefore, an object of the invention to provide a continuous casting machine having the capability for casting continuous metal bars.

It is a further object of the invention to provide a continuous casting machine capable of casting continuous metal tubes.

It is a still further object of the invention to provide a casting machine capable of casting material in a variety of cross-sectional shapes over a substantial range of dimensions.

It is another object of the invention to provide a continuous casting machine which eliminates the need for the rotating casting wheel.

It is another object of the invention to provide a continuous casting machine which is resistant to thermal stresses of accompanying high-temperature casting.

These and other objects of the invention are provided by a continuous casting machine comprising a plurality of flexible belts, and means defining a continuous path for each belt including a common region of proximate travel wherein the paths are generally parallel and radially disposed about a central axis. Means are provided for conducting the belts along their respective paths, and in a common direction through the proximately travelled region, the paths being spaced therein, to define a travelling openended axially extending mold cavity between the opposing belt surfaces. Means are provided at one cavity end for continuously introducing a quantity of molten material into the mold cavity, and means for continuously collecting the solidified material are provided at the other cavity end.

DESCRIPTION OF THE PREFERRED EMBODIMENT

Figure 1:
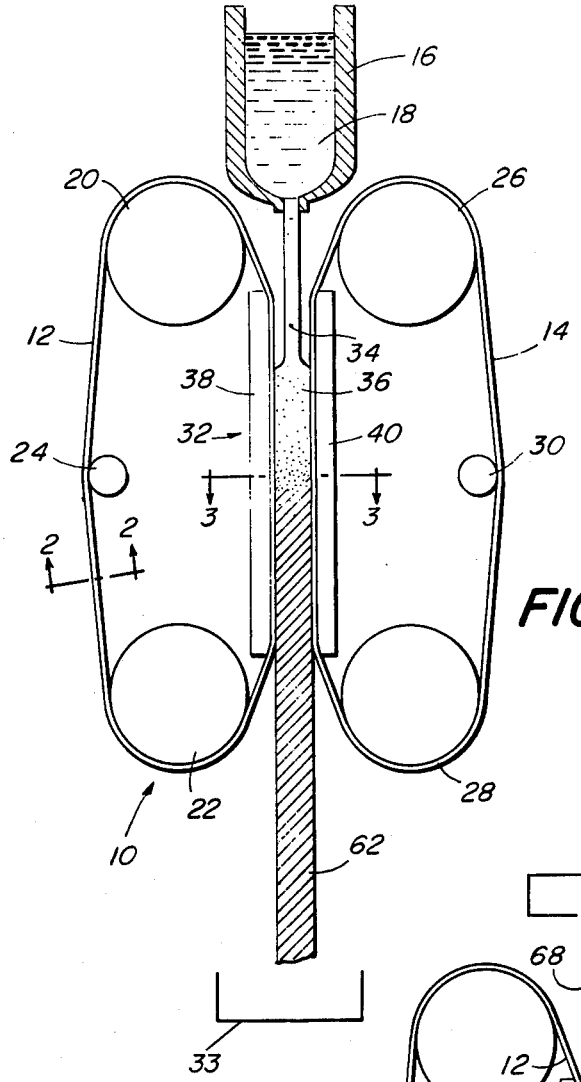
FIG. 1 is a schematic sectional illustration of a continuous tube casting apparatus according to the invention.

FIG. 1 is a sectional schematic representation of a continuous bar casting assembly, shown generally at 10.

The embodiment herein described comprises four flexible belts, although any number may be conveniently used. Additionally, two of the four belts have been deleted from FIG. 1 for the sake of clarity, but their positioning and function will be readily apparent from the following description together with the remaining figures.

Returning to FIG. 1, the continuous bar casting assembly 10 is shown comprising a pair of endless flexible belts 12, 14. A continuous path for belt 12 is defined by a pair of clockwise rotating pulleys 20, 22, 24. Similarly, a continuous path for belt 14 is defined by a pair of counterclockwise rotating pulleys 26, 28, 30. The belts 12, 14 are thereby conducted in a common downward direction through a region of proximate travel 32. The opposing belt surfaces define a travelling open ended mold channel 36 which extends axially downward along the region 32.

The casting apparatus further comprises a means for injecting a quantity of molten material into the travelling mold cavity 32, such as a crucible 16 containing a molten material 18 and having a nozzle member 34 adjacent to the upper end of the channel. The molten material 18 is poured into the upper end of the downwardly travelling cavity and solidifies as it travels downward to form a bar 62 having a shape defined by the inner belt faces. The resultant bar 62 emerges at the bottom of the region 32 from between the diverging belts and may be collected by a collecting means 35.

Belt speed is dependent on many parameters which determine the cooling time required to solidify the molten material, including the dimensions and material composition of the cast product; a calculation of requisite cooling time may be made by one skilled in the art. Belt speed may be consequently adjusted to permit molten material to remain in the region 36 for a sufficient time. Because the cooling time is the product of belt speed and the length of region 36, speeds of up to one foot per second may be obtained by simple elongation of the region 36.

It may be appreciated that any number of belts may be used and that the present description of four belts is merely illustrative. By proper selection of the number of belts or of the inner belt face configuration, bars having such shapes as triangular, square, hexagonal or circular and cross-sections in the preferred range of 0.1 to 0.5 inches (0.25 to 1.25cm) may be produced. The belts may be described in more detail with reference to FIGS. 2A and 2B.

Figure 2A:
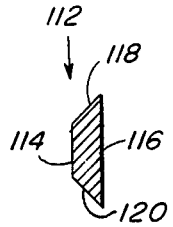
FIGS. 2A and 2B are cross-sections taken along line 2—2 in FIG. 1 of cavity-defining belts, which may be used in the continuous casting apparatus according to the invention.
Figure 2B:
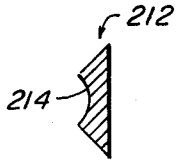

FIGS. 2A and 2B are lateral cross-sections taken along line 2—2 of FIG. 1, showing belts which may be used in the continuous casting device disclosed herein. Referring first to FIG. 2A, a belt 112 is shown having an inner face 114 which, in conjunction with the corresponding faces of the remaining belts, defines the cavity wall during the periods of travel through the proximately travelled region 32 (FIG. 1). The belt 112 further comprises an outer face 116 sized to fit within the circumferential groove of the pulleys and a pair of oblique edges 118, 120. As will be discussed below, the edges 118, 120 are contiguous with and may supportably contact, the complimentary edges of adjacent belts while travelling through the region 36 (FIG. 1) in the proximate relationship therewith. In FIG. 2A, the inner face 114 is shown as comprising a substantially flat surface. As indicated above, a variety of bar shapes may be produced by selectively contouring the inner belt face. For example, FIG. 2B illustrates a belt having a contoured face 214 which may be used to cast bars of generally circular shape. The belts may be fabricated from any material flexible enough to form an endless loop and having the requisite material strength to withstand the temperatures of the molten material. The material may be, for example, steel or a carbon alloy thereof.

Returning for the moment to FIG. 1 and with reference to region 32, it can be appreciated that means are desirable for insuring the continuity of the edge-to-edge contact by adjacent belts throughout the proximately travelled region 32. Guide means may be correspondingly provided in the form of a plurality of axially extending rods, such as those shown at 38, 40. The rods may be more clearly described by reference to FIG. 3.

Figure 3:
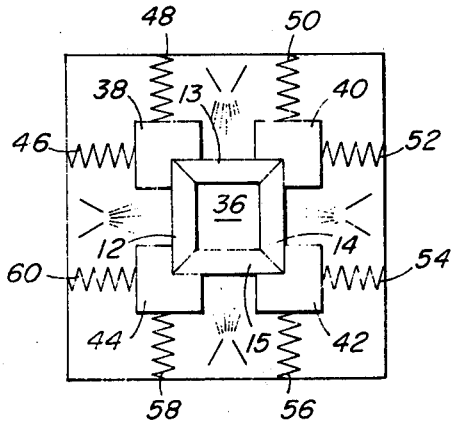
FIG. 3 is a lateral cross-section of the continuous casting apparatus within the region of proximately travelling belts and taken along line 3—3 in FIG. 1.

FIG. 3 is a lateral cross-section of the continuous casting apparatus according to the invention, and taken along lines 3—3 in the region 32 of proximate travel. In FIG. 3, the belts 12 and 14 are shown in their opposing proximate relationship, as are the previously deleted pair of belts now indicated at 13 and 15. For the sake of simplicity, the belts have been shown as having substantially flat faces, but it is understood, as indicated above, that the shapes of any and all belts may vary in accordance with the desired bar shape. The belts 12, 13, 14, 15 are moving downward into the plane of the page and define a travelling mold cavity 36 therebetween. Generally encircling the region of proximately travelling belts are rods, 38, 40, 42, 44. Each rod has an axially extending notch for receiving and guiding a pair of adjacent outer belt faces in edge-to-edge abutment along the region of proximate travel 32 (FIG. 1). The "key stone" shape of the belts allow them to be "trapped" to a stable shape forming the movable open ended molds as the belts are guided through the region by the rods.

Although it is desirable that the abutting edges be fairly tight, a sealing contact is unnecessary in that the molten material will generally not leak between the abutting edges, but will solidify at the interface of the edges in an essentially self-sealing manner.

It may be appreciated that the lateral dimension of the belts may change when subjected to the temperatures necessary in the casting process. It is, therefore, desirable both to relieve the thermally induced internal compressional forces resulting from the expansion of the belt within the guide means, while maintaining the adjacent belts in edge-to-edge contact through the proximately travelled region, and to further maintain the guiding relationship between the rods and the belts during those periods in which the contained molten material is cooling and the belts are consequently contracting. Means are, therefore, provided for sizing the rod guides in accordance with the dimensional changes in the belt material. To that end, the rods may be coupled for relative movement in two directions by such means as springs 46, 48, 50, 52, 54, 56, 58, 60. Thus, the expansion of belt 12 between the rods 38, 44 will move apart and respectively compress springs 48, 58, which will consequently exert an opposing force to maintain the rods in a belt-guiding relationship during periods of subsequent cooling wherein the belt 12 contracts.

In addition to the casting of bar-shaped products, the invention embraces embodiments having the ability to continuously cast tube-shaped products. A second embodiment of the invention directed toward the casting of a tube-shaped product may be explained with reference to FIG. 4, wherein elements similar to those described with reference to FIG. 1 are identified as such so that the embodiment may be more efficiently described.

Figure 4:
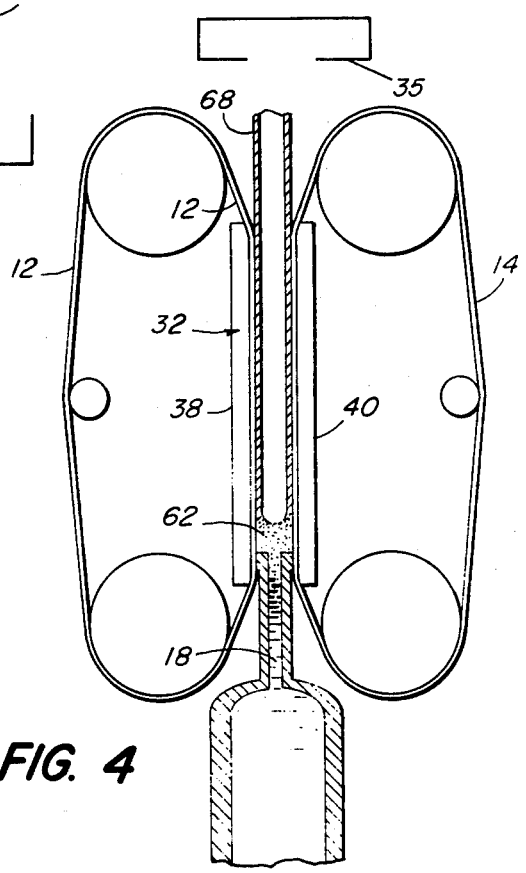
FIG. 4 is a sectional schematic diagram of a continuous tube casting assembly according to the invention.

FIG. 4 is a sectional schematic representation of a continuous tube casting assembly made in accordance with the invention. It differs from the embodiment of FIG. 1 in that the defined cavity is somewhat larger, and the direction of belt motion has been reversed, so that the belts travel upward through the region 32. The molten material 18, is injected into the bottom portion of the region 32, and forms a molten pool 62 therein. The material along the periphery of the pool 62 adheres to the cavity wall as defined by the upward travelling belts 12, 14 and solidifies as it travels upwardly. The resultant cast tube 68 is ejected by the diverging belts at the upper end of the region 32 where it may be collected by a collecting. By properly contouring the inner belt faces, tubing of any desirable shape may be drawn from the top of the region 32 in a continuous manner.

It may be additionally appreciated that the wall thickness of the tube may be controlled by varying the period over which the mold is in contact with the molten pool 62. One may also appreciate that other changes and modifications could also be apparent to one skilled in the art and may be made without departing from the spirit of the invention as defined by the following claims.

I claim:

1. A continuous casting assembly comprising:

a plurality of flexible belts;

means defining a continuous path for each belt including a common region of proximate travel wherein the paths are generally parallel and radially disposed about a central axis;

means conducting the belts along their respective paths and in a common direction through the proximately travelled region, the paths being spaced therethrough to define a travelling open-ended axially-extending mold channel between the opposing surfaces of the belts, each of the belts including an inner face for defining a portion of the channel wall during the period of proximate travel, an outer face, and a pair of oblique edges therebetween, the edges of each belt being contiguous with a complimentary edge of an adjacent belt during the period of proximate travel to supportably contact the adjacent edge through the proximately travelled region;

means for continuously injecting a quantity of molten material into one end of the channel;

means for cooling the molten material to a solid form while within the channel; and means for collecting the solidified material at the other end of the channel.

2. The apparatus of claim 1 wherein the inner belt faces are flat.

3. The casting apparatus of claim 1 wherein at least one of the inner belt faces are contoured.

4. The apparatus of claim 1 wherein the path defining means includes guide means for maintaining the adjacent belts in edge-to-edge contact through the proximately travelled region.

5. Apparatus of claim 4 including temperature compensation means for sizing the guide means in accordance with thermally induced dimensional changes in the belt material.

6. The apparatus of claim 4 wherein the guide means includes a plurality of axially extending rods generally encircling the region of proximately travelling belts, each rod having an axially extending notch for receiving and guiding a pair of adjacent outer belt faces in edge-to-edge abuttment along the region of proximate travel.

7. The apparatus of claim 6 including means coupling the rods for relative movement in response to transversely directed thermally generated expansive forces applied thereby by the belts; and means for applying opposing forces to maintaining the rods in a belt-guiding relationship during thermally-induced contractual changes in the belt material.

8. Apparatus of claim 1 wherein the cross-section of the channel is in the range of 0.1 to 0.5 inches.

9. Apparatus of claim 1 wherein the belts are conducted at a speed in the range of up to one foot per second.

10. Apparatus of claim 1 wherein the belts converge above the region of proximate travel, move in a generally downward direction and diverge below the region, the molten material injection means injects molten material into the top portion of the channel, and a collecting means is located at the bottom of the region, whereby the solidified material is in the shape of a generally continuous bar having a cross-section defined by the channel.

11. A continuous casting assembly comprising:

a plurality of flexible belts;

means defining a continuous path for each belt including a common region of proximate travel wherein the paths are generally parallel and radially disposed about a central axis;

means conducting the belts along their respective paths and in a generally upward direction through the proximately travelled region, the paths being spaced therein to define a travelling open-ended axially-extending mold channel between opposing surfaces of the belts;

means for continuously injecting a quantity of molten material into the bottom channel portion;

means for cooling the molten material to a solid form while within the channel; and means for collecting the solidified material at the top portion of the channel, whereby the solidified material is ejected in the form of a continuous tube having an outer cross-section defined by the channel cross-section.

12. The assembly of claim 11 wherein the belts converge below the region, move in a generally upward direction and diverge above the region.

* * * * *